US005492410A

United States Patent [19]

Cocozza

[11] Patent Number: 5,492,410

[45] Date of Patent: Feb. 20, 1996

[54] CONTAINER AND METHOD FOR FORMING THE SAME

[75] Inventor: David D. Cocozza, Birdsboro, Pa.

[73] Assignee: Graphic Packaging Corporation, Paoli, Pa.

[21] Appl. No.: 271,109

[22] Filed: Jul. 6, 1994

[51] Int. Cl.[6] ..... B65D 30/08; B65D 30/18; B65D 33/16

[52] U.S. Cl. ..... 383/1; 383/67; 383/111; 383/211

[58] Field of Search ..... 383/1, 67, 211, 383/111, 124

[56] References Cited

U.S. PATENT DOCUMENTS

| | | | |
|---|---|---|---|
| 2,327,024 | 8/1943 | Davidson, Jr. et al. | 383/211 |
| 3,212,698 | 10/1965 | Balcom | 383/67 |
| 3,301,466 | 1/1967 | Perino et al. | 383/211 |
| 3,910,488 | 10/1975 | Goodrich . | |
| 3,958,749 | 5/1976 | Goodrich . | |
| 4,550,442 | 10/1985 | Lepisto . | |
| 4,681,228 | 7/1987 | Kerry et al. . | |
| 4,982,064 | 1/1991 | Hartman et al. . | |
| 5,178,469 | 1/1993 | Collinson | 383/1 |
| 5,281,027 | 2/1994 | Thrall . | |
| 5,393,143 | 2/1995 | Muhs | 383/111 |
| 5,403,096 | 4/1995 | Aagesen | 383/1 |

*Primary Examiner*—Stephen P. Garbe
*Attorney, Agent, or Firm*—Klaas, Law, O'Meara & Malkin

[57] ABSTRACT

An inner container and an outer container folded together to form a container having opposite gusseted side walls, planar front and back walls and a bottom wall comprising portions of the inner and outer containers not adhesively secured together and having a bottom surface comprising portions of the outer container and an outer member adhesively secured to the portions of the outer container forming the bottom surface.

7 Claims, 1 Drawing Sheet

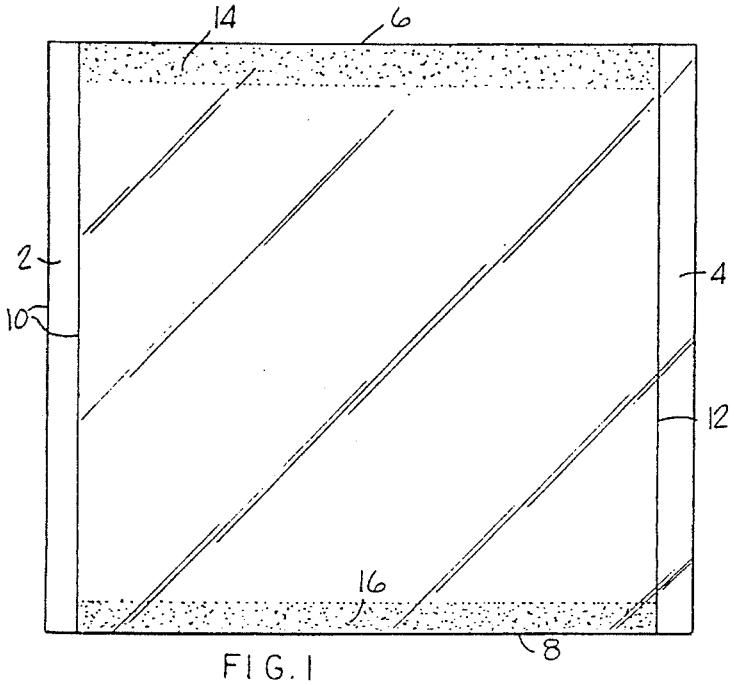
FIG. 1
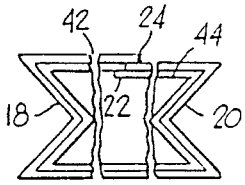
FIG. 2
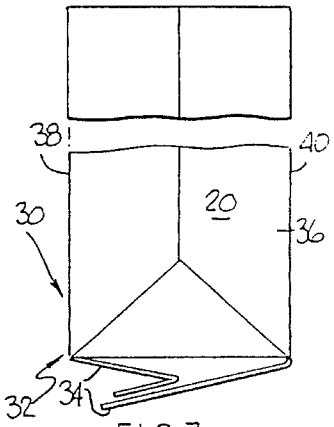
FIG. 3
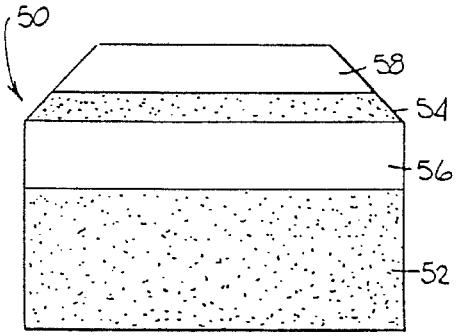
FIG. 4
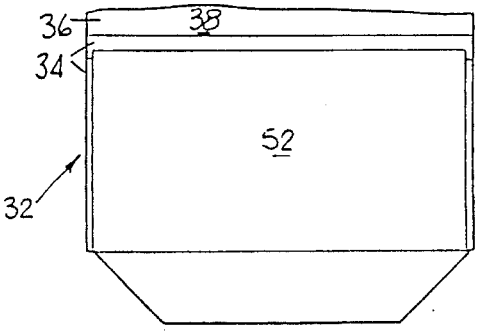
FIG. 5
FIG. 6
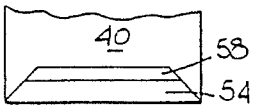
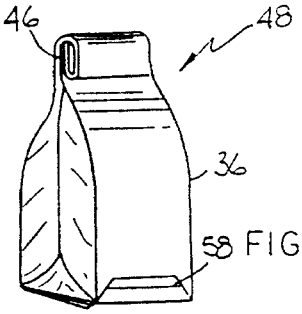
FIG 7
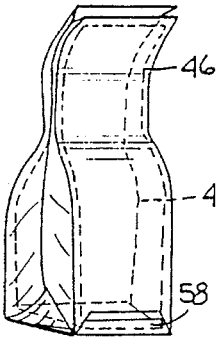
FIG. 8
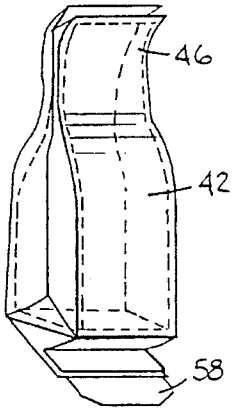
FIG. 9

CONTAINER AND METHOD FOR FORMING THE SAME

FIELD OF THE INVENTION

This invention relates generally to containers for use in marketing materials that desirably should not come into contact with the user.

BACKGROUND OF THE INVENTION

There are many types of containers on the market for packaging pulverent or granular material that may be opened and used without coming into contact with the user. These containers comprise an outer container formed from a non-water soluble material and a separate inner container formed from a water soluble material so that the outer container may be opened and the inner container dumped into a water filled vessel or tank or other fluid holders. All of these containers have advantages and disadvantages. Therefore, there continues to exist a need for a container of this nature that is easy to manufacture and use. Also, the container should be as economical as possible yet still provide the desired results.

BRIEF DESCRIPTION OF THE INVENTION

This invention provides a container having inner and outer containers each having two opposite gusseted sidewalls, planar front and back walls and a bottom wall comprising portions of the inner and outer containers folded and not adhesively secured together to provide a bottom surface comprising portions of the outer container. An outer member is adhesively secured to at least the portions of the bottom surface of the outer container to hold the portions in place. A pull tab is integral with the outer member and is used to open the bottom of the outer container.

In a preferred embodiment of the invention, an outer container is formed from a non-water soluble material and an inner container is formed form a water soluble material. The outer and inner containers are folded together and have a rectangularly shaped bottom portion so that the outer and inner containers are self supporting when the bottom portion is placed on a surface. The portions of the outer and inner containers forming the rectangularly shaped bottom portion are held together by a fugitive adhesive during the folding thereof. The bottom portion has a bottom surface comprising folded portions of the outer container. An outer member is adhesively secured to the folded portions to hold the bottom portion together. The outer member has an integral adhesive free pull tab for use in opening the bottom portion. The facing portions of the bottom portion of the inner container are sealed together. Each of the outer and inner containers has two gusseted sidewalls and planar front and back walls. Another portion of the outer member is adhesively secured to a portion of one of the front or back walls. This is particularly necessary if the bottom surface has only one portion.

The above-described container is formed using a first blank formed from a non-water soluble material and a second blank formed from a water soluble material and each of the first and second blanks have a top edge, a bottom edge and two side edges. The second blank is superposed over the first blank in an offset relationship. The first and second blanks are joined together adjacent to the top edges with a permanent adhesive, and the first and second blanks are joined together adjacent to the bottom edges with a fugitive adhesive. The first and second blanks are then folded to have gusseted side walls and planar front and back walls. The portions of the second blank adjacent to the two side edges of the second blank are joined together to form a side seam. The portions of the first blank adjacent to the two side edges of the first blank are joined together to form a side seam with the second blank located inside of the first blank. The first and second blanks are folded to form a bottom surface comprising portions of the first blank. An outer member is placed over at least a portion of the bottom surface and at least a portion thereof is adhesively secured to the portions of the first blank forming the bottom surface and has another portion that is not secured to the bottom surface to function as a pull tab. The facing portions of the second blank adjacent to the bottom edge are sealed together. Also, another portion of the outer member may be secured to a portion of one of the front or back walls.

The first blank comprises a laminated product having an outer layer formed from a non-water soluble paper such as clay coated bleached kraft or other materials having similar characteristics and an inner layer comprising a plastic film or coating such as oriented polyester or other materials having similar characteristics. The second blank is formed from a water soluble material such as polyvinyl alcohol or other materials having similar characteristics. The fugitive adhesive is one that will function as an adhesive while wet but will not function as an adhesive when dry. A fugitive adhesive for use in this invention is polyvinyl alcohol or other materials having similar characteristics. The permanent adhesive is pressure sensitive acrylic or other materials having similar characteristics.

BRIEF DESCRIPTION OF THE DRAWINGS

An illustrative and presently preferred embodiment of the invention is illustrated in the accompanying drawing in which:

FIG. 1 illustrates two blanks for forming a container of this invention;

FIG. 2 is an enlarged cross-sectional view of the first and second blanks after a first series of folding operations;

FIG. 3 is a side elevational view of the container before the outer member is secured thereto;

FIG. 4 is a bottom plan view of the outer member;

FIG. 5 illustrates a portion of the outer member being secured to the bottom surface of the outer container;

FIG. 6 illustrates a portion of the outer member being secured to a portion of the front wall of the outer container;

FIG. 7 illustrates a package; and

FIGS. 8–9 illustrate the opening of the package.

DETAILED DESCRIPTION OF THE INVENTION

In FIG. 1, there is illustrated a first blank 2 formed from a non-water soluble material and a second blank 4 formed from a water soluble material. Each of the first and second blanks 2 and 4 have a top edge 6, a bottom edge 8 and opposite side edges 10 and 12. The second blank 4 is superposed over the first blank in a slightly offset relationship. The first and second blanks 2 and 4 are joined together adjacent to the top edges 6 by a permanent adhesive 14 and are joined together adjacent to the bottom edges 8 by a fugitive adhesive 16. The first and second blanks 2 and 4 are folded using conventional folding apparatus such as that marketed by Graphic Packaging Corporation to form opposite gusseted side walls 18 and 20, FIG. 2. The portions of the second blank 4 adjacent to the side edges 10 and 12 are permanently joined together to form a side seam 22 and the portions of the first blank 2 adjacent to the side edges 10 and 12 are permanently joined together to form a side seam 24.

The first and second blanks 2 and 4 are then folded using conventional folding apparatus such as that marketed by Graphic Packaging Corporation to form a gusseted bottom portion 30 having a bottom surface 32 formed by portions 34 of the first blank 2 to form a container 36 having a front wall 38 and a back wall 40. The gusseted sidewalls 18 and 20 and the bottom portion 30 allow the container 36 to be folded flat for further operations and shipping. The container 36 thus formed has an outer container 42 formed from a non-water soluble material and an inner container 44 formed from a water soluble material.

In FIG. 4, there is shown an outer member 50 which functions to hold the bottom portion 30 together after the fugitive adhesive 16 is no longer functioning as an adhesive. The outer member 50 has a relatively large permanent adhesive section 52 and a relatively small permanent adhesive section 54 separated by a non-adhesive section 56. A non-adhesive pull tab 58 is an integral part of the outer member 50.

In FIG. 5, there is illustrated one method of securing the outer member 50 to the container 36. The container 36 is folded to be flat with the bottom surface 32 exposed and front wall 38 exposed. The relatively large permanent adhesive section 52 is placed over the exposed portions 34 of the bottom surface 32 to secure them together. The container 36 is turned over to expose the back wall 40. The relatively small permanent adhesive section 54 is then secured to a portion of the back wall 40 leaving the pull tab 58 free to be grasped as described below. Other methods may be used to secure the outer member to the container 36. A plurality of containers 36 are formed in a similar manner and packaged in a flat relationship and shipped to a user.

The containers 36 may be filled using a variety of conventional machines. In one filling and sealing operation, the container is opened and the inner container 44 is filled with the desired material. The permanent adhesive portion 14 is trimmed away and the top of the inner container is sealed. The top end 46 of the outer container is double-turned and sealed to form a package 48, FIG. 6, having an exposed outer container 42 of a non-water soluble material protecting an enclosed filled inner container 44 of a water soluble material.

When it is desired to remove the filled inner container 42, the top end 46 is opened as illustrated in FIG. 8. The pull tab 58 is then grasped and pulled away from the container 36 to sever the bottom surface 32 therefrom. The pull tab 58 acts as a handle to support the container. The inner container 44 can then be deposited wherever desired by dumping it out of the top of the opened container.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A container comprising:

an outer container formed from a non-water soluble material;

an inner container formed from a water soluble material;

said outer and inner containers folded together and having a rectangularly shaped bottom portion so that said outer and inner containers are self supporting when said bottom portion is placed on a surface;

said portions of said outer and inner containers forming said rectangularly shaped bottom portion being held together by a fugitive adhesive during said folding thereof;

said bottom portion having a bottom surface comprising folded portions of said outer container;

an outer member adhesively secured to said folded portion to hold said bottom portion together; and said outer member having an integral adhesive-free pull tab for use in opening the bottom portion.

2. A container as in claim 1 wherein:

said bottom portion of said inner container being sealed together.

3. A container as in claim 1 wherein:

each of said outer and inner containers having gusseted sidewalls and planar front and back walls.

4. A container as in claim 3 wherein:

said bottom portion of said inner container being sealed together.

5. A container as in claim 1 and further comprising:

another portion of said outer member being adhesively secured to a portion of one of said front or back walls.

6. A container as in claim 5 wherein:

each of said outer and inner containers having gusseted sidewalls and planar front and back walls.

7. A container as in claim 6 wherein:

said bottom portion of said inner container being sealed together.

* * * * *